US006935809B2

(12) United States Patent
Svensson

(10) Patent No.: US 6,935,809 B2
(45) Date of Patent: Aug. 30, 2005

(54) METHOD AND MEANS FOR MAKING AN EMBANKMENT

(76) Inventor: Gerhard Svensson, Hol. Pl 1234, SE-441 93 Alingsås (SE)

( * ) Notice: Subject to any disclaimer, the term of this patent is extended or adjusted under 35 U.S.C. 154(b) by 10 days.

(21) Appl. No.: 10/483,005

(22) PCT Filed: Jul. 5, 2002

(86) PCT No.: PCT/SE02/01347

§ 371 (c)(1),
(2), (4) Date: Jan. 2, 2004

(87) PCT Pub. No.: WO03/004780

PCT Pub. Date: Jan. 16, 2003

(65) Prior Publication Data

US 2004/0179898 A1 Sep. 16, 2004

(30) Foreign Application Priority Data

Jul. 5, 2001 (SE) ..... 0102423

(51) Int. Cl.[7] ..... E02B 7/00; E02B 7/08

(52) U.S. Cl. ..... 405/107; 405/31; 405/112; 405/116; 256/13

(58) Field of Search ..... 405/21, 25–28, 405/29, 31, 33, 35, 107, 110, 112, 116; 256/13, 15

(56) References Cited

U.S. PATENT DOCUMENTS

| | | | | |
|---|---|---|---|---|
| 898,984 A | | 9/1908 | McFarlane | |
| 2,609,666 A | | 9/1952 | Mesnager | |
| 4,136,995 A | * | 1/1979 | Fish | 405/115 |
| 4,997,697 A | * | 3/1991 | Malhotra | 428/32.13 |
| 5,113,792 A | * | 5/1992 | Jones et al. | 405/25 |
| 6,676,333 B2 | * | 1/2004 | Wiseman et al. | 405/114 |

FOREIGN PATENT DOCUMENTS

| | | |
|---|---|---|
| GB | 1262851 | 9/1972 |

* cited by examiner

*Primary Examiner*—Jong-Suk (James) Lee

(57) ABSTRACT

A method for making an embankment in areas and forming a barrier against water with the help of supports. For this purpose, corrugated steel sheets or corrugated panels of some other material, such as plastic or aluminum, are folded across their longitudinal direction along perforations in the sheets so that sections of the sheet extend at an angle to one another, and the aforementioned folded formed barrier supports are caused to be positioned on a supporting surface so that a folded section of each sheet forms a barrier support (16) that faces towards the intended damming area. The barrier support is formed laterally by a number of mutually overlapping folded corrugated sheets. An arrangement for the execution of the method.

27 Claims, 10 Drawing Sheets

METHOD AND MEANS FOR MAKING AN EMBANKMENT

This application claims priority to PCT Application Number PCT/SE02/001347 filed on Jul. 5, 2002 and Swedish Application Number 0102423-1 filed on Jul. 5, 2001.

BACKGROUND OF THE INVENTION

1. Field of the Invention

The present invention relates to a method for making an embankment in areas and forming a barrier against water with the help of a support.

2. Description of Related Art

Previously disclosed is the making of temporary embankments as a means of protection against flooding by water in low-lying areas or in areas that are extra-sensitive to water, such as residential areas, factories, electrical installations, roads, railway tracks and similar areas. Bags filled with sand and gravel or other similar supports have been used in this case, which are built together laterally and vertically to form an essentially liquidtight barrier. Use has also been made of supports in the form of, for example, objects such as rocks and load pallets, and a canvas has been positioned facing towards the water in question from which it was wished to provide protection and over the objects in question.

All of the aforementioned methods have been time-consuming and have required bulky and heavy aids and, after the water has receded, the supports used were considered to be unhealthy material because wastewater had come into contact with them, which had required extra measures in order to prevent infection. This meant that major costs were also incurred for the destruction and incineration of barriers even if a flooding event was coped with successfully without damage to buildings and people from the flooding water.

SUMMARY OF THE INVENTION

The principal object of the present invention is thus, in the first instance, to make available a method which solves inter alia the above-mentioned problems and a large number of other problems.

The aforementioned object is achieved by means of a method in accordance with the present invention, which is characterized essentially in that corrugated steel sheets or corrugated panels of some other material, such as plastic or aluminium, are folded across their longitudinal direction along perforations in the sheets so that sections of the sheet extend at an angle to one another, in that the aforementioned folded formed barrier supports are caused to be positioned on a supporting surface so that a folded section of each sheet forms a barrier support that faces towards the intended damming area and is formed laterally by a number of mutually overlapping folded corrugated sheets.

A further object of the invention is to make available effective means with which the method in accordance with the foregoing is executed.

The aforementioned further object is achieved by means of an arrangement in accordance with the present invention, which is characterized essentially in that the aforementioned support consists of laterally interconnectable and longitudinally corrugated steel sheets or corrugated panels of some other material, such as plastic or aluminium, in that the aforementioned sheets are perforated across their longitudinal direction in a direction from one side of the sheets and all the way through them as far as the opposing other side of the sheets, in that the aforementioned perforations are so arranged as to form folding guides for the sheets in question, and in that, in the folded-up angled position, the sheets form a barrier that is capable of being set up on a surface as a support and protection against surrounding water.

BRIEF DESCRIPTION OF THE DRAWINGS

The invention is described below as a number of preferred illustrative embodiments, in conjunction with which reference is made to the accompanying drawings, in which.

DETAILED DESCRIPTION OF THE PREFERRED EMBODIMENTS

Figure 1:
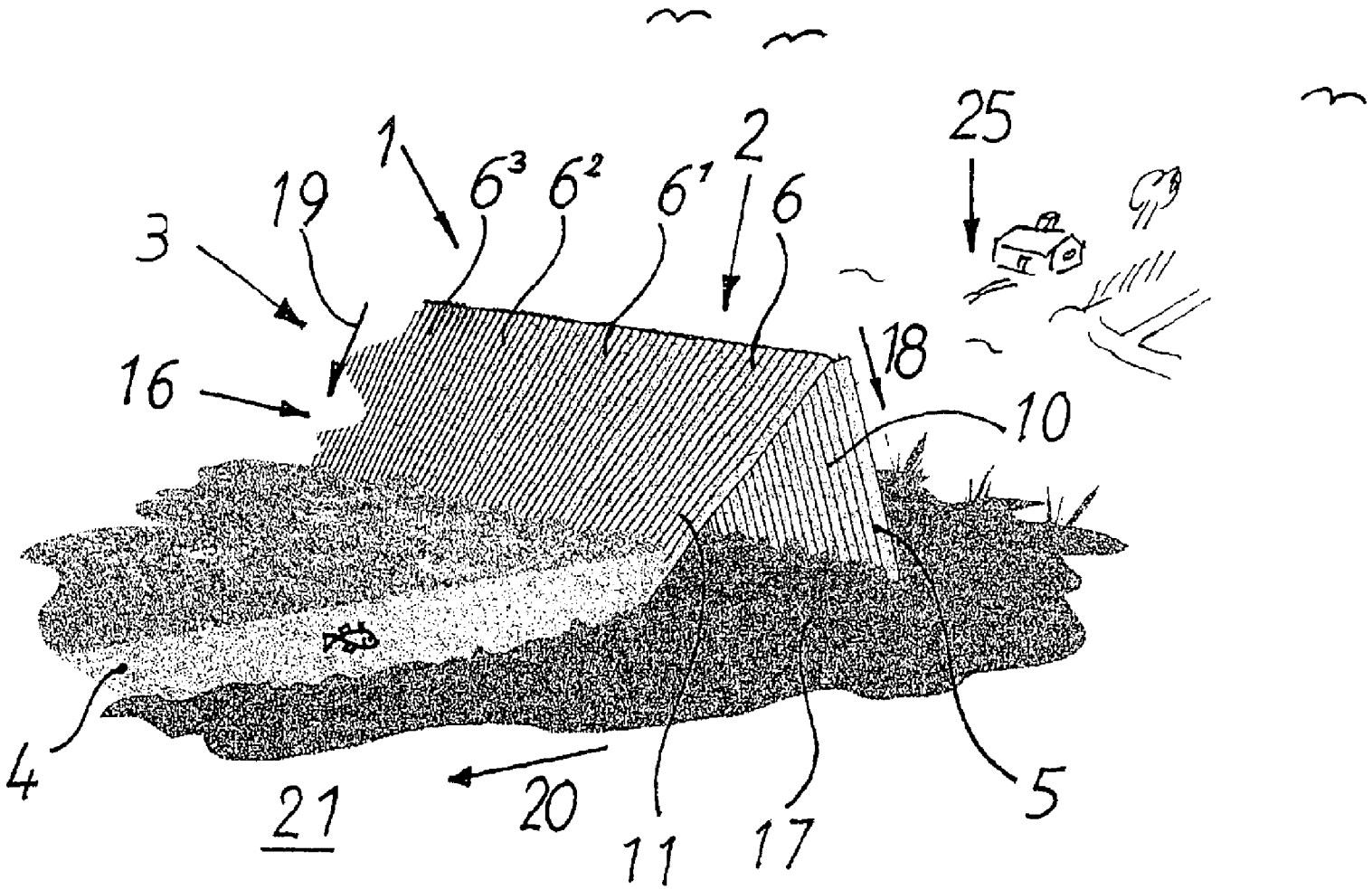
FIG. 1 shows a first illustrative embodiment of the invention.
Figure 2:
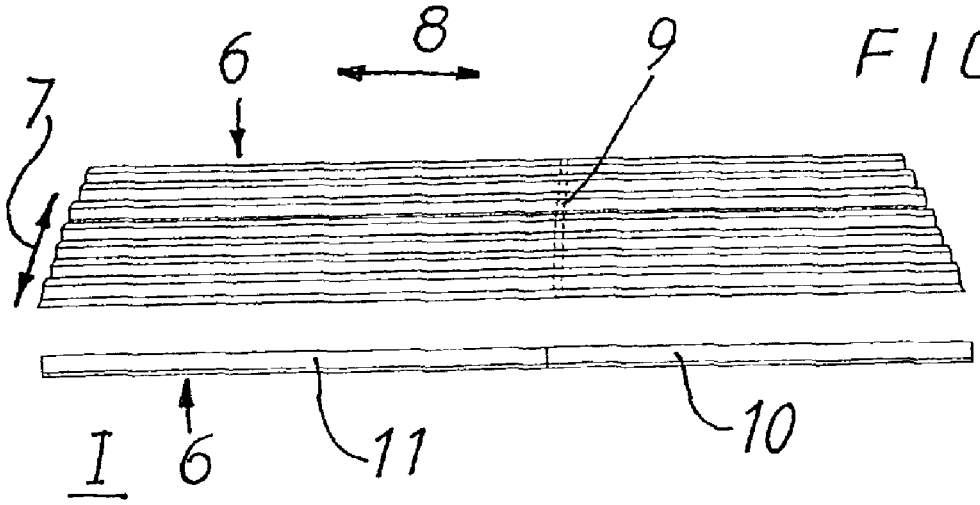
FIGS. 2–4 show an arrangement for executing the invention and in various stages.
Figure 3:
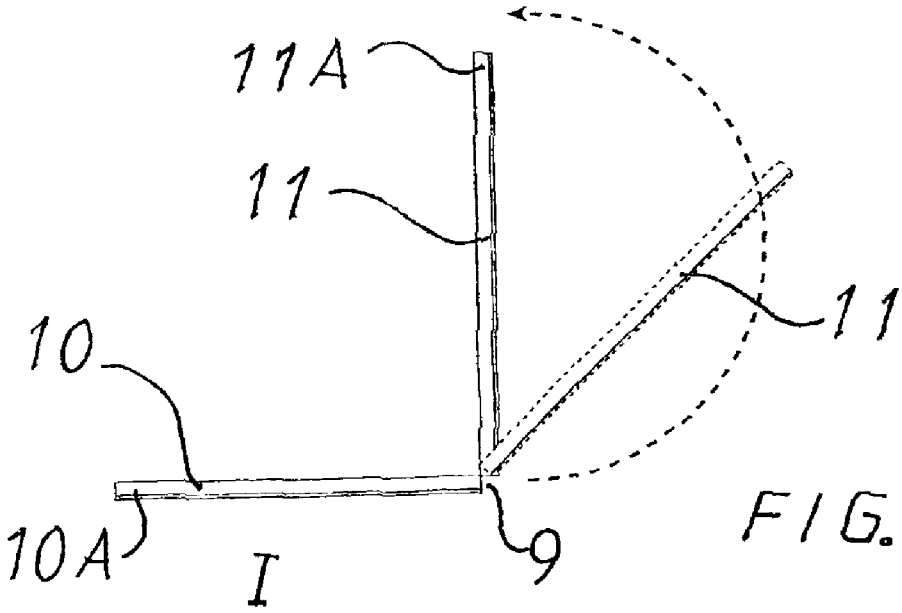

A barrier in accordance with the present invention gives the following advantages:

- It is light in weight and takes up little space.
- It is a strong structure.
- It can be readily adapted and manufactured to suit different depths of flooding, e.g. 50 cm–200 cm.
- It is hygienic due to the ease with which it can be washed down.
- It is sabotage-proof, for example against knife attack.
- It is inexpensive and simple to manufacture in large quantities.
- No extra materials, such as timber in the form of load pallets, are required, and everything needed is provided.
- It is recyclable due to the fact that it consists essentially of sheet steel.
- It cannot float away and obstruct a drain or constitute a hazard to shipping.
- It is possible by simple means to make curved barriers and to cause them to sweep in the desired direction.
- It is collapsible and easy to dismantle and move.
- It is flexible and adapts to the form of the supporting surface.

A method in accordance with the present invention for making an embankment 1 in areas 25; 125 and for forming a barrier 3 against water 4 therefrom with the help of supports 5 involves folding corrugated steel sheets or corrugated panels of some other material, such as plastic or aluminium, 6, $6^1$, $6^2$, $6^3$ . . . across 7 the longitudinal direction 8 of the sheets along perforations 9, $9^1$, $9^2$, $9^3$ in the sheets 6, $6^1$, $6^2$, $6^3$ . . . so that formed sheet sections 10, 11; 12, 13, 14, 15 extend at an angle A; B, C, D, E to one another. The expression sheet is used throughout in order to simplify the text. The aforementioned folded formed barrier supports 16; 116 are caused to be positioned on a supporting base 17 so that pairs or a single folded section 10, 11; 13 thereof face in a direction 18, 19 down towards the ground 17 or are in close contact with the ground with a folded supporting section 13. A folded section of the respective sheet in this case forms a barrier support that faces in the direction 20 towards the intended damming area 21, i.e. the area from which water 4 arrives or in which it can be expected to rise against the aforementioned barrier support 16; 116. The aforementioned barrier support 16; 116 is formed laterally by a number of mutually overlapping folded corrugated sheets 6, $6^1$, $6^2$, $6^3$ . . . and where the trough and the peak 23 of mutually meeting sheets overlap one another along the longitudinal parallel lateral edges.

The aforementioned formed barrier support 16; 116 is caused to be covered with an essentially liquidtight membrane, such as rubber sheeting, a tarpaulin or similar. In accordance with the illustrative embodiments, which are shown in the drawings in FIGS. 12, 13 and 16, a liquidtight membrane of this kind can be attached to the barrier support 116 in a variety of ways that are explained below.

Figure 4:
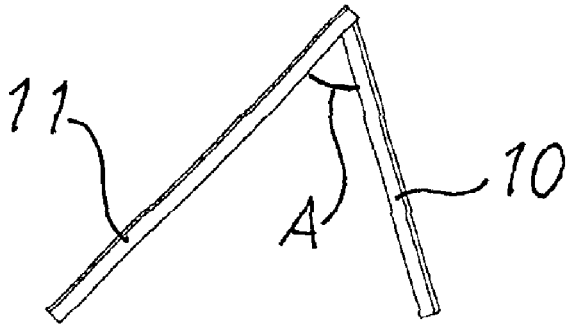
Figure 5:
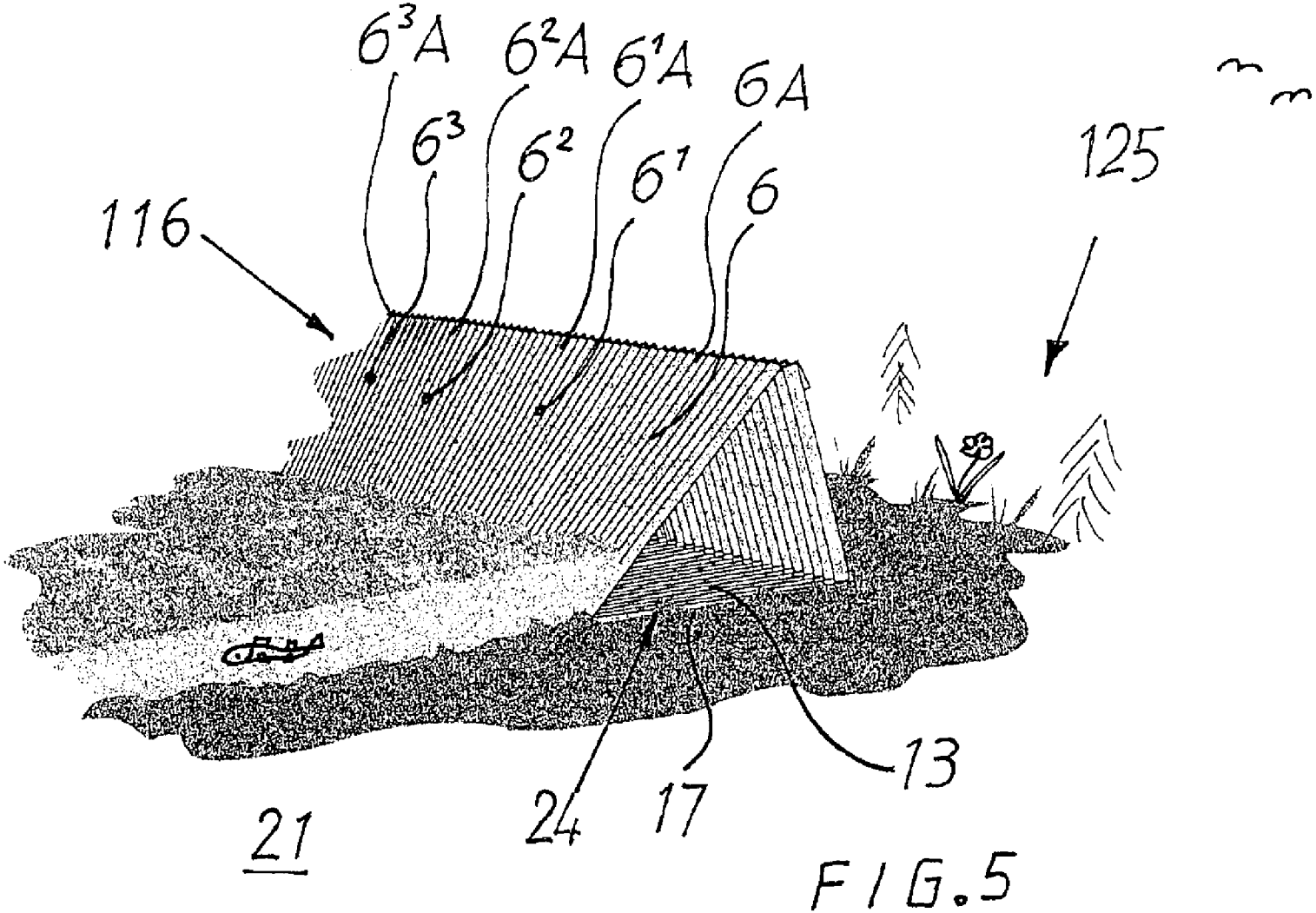
FIG. 5 shows a second illustrative embodiment of the invention.
Figure 6:
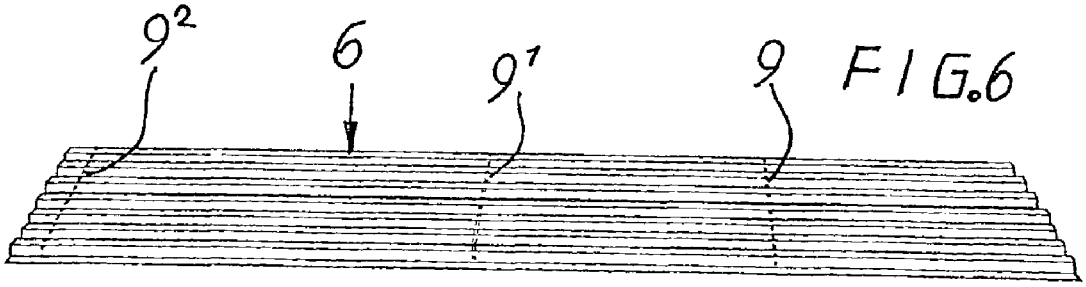
FIGS. 6–9 show an arrangement for executing the invention in accordance with the second illustrative example and in various stages.
Figure 7:
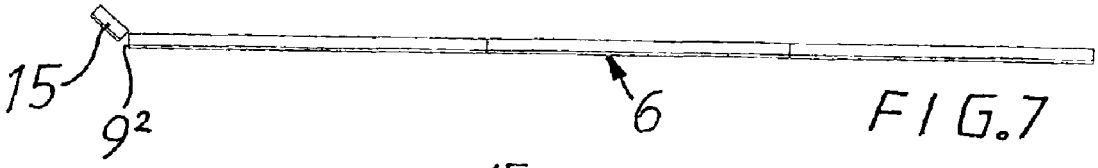
Figure 8:
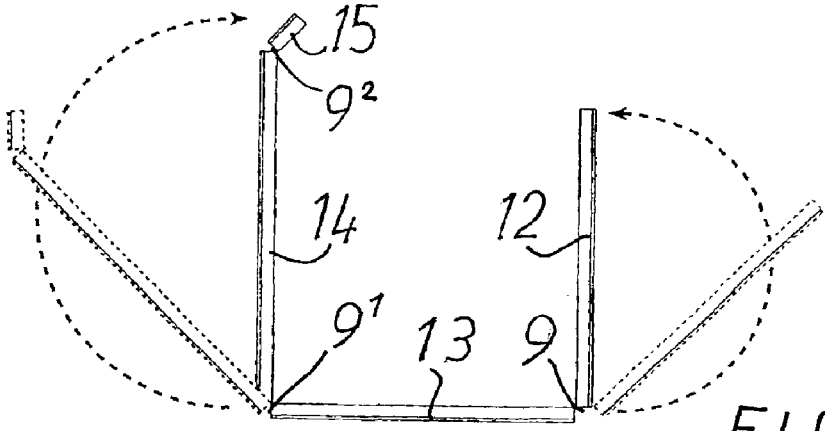
Figure 9:
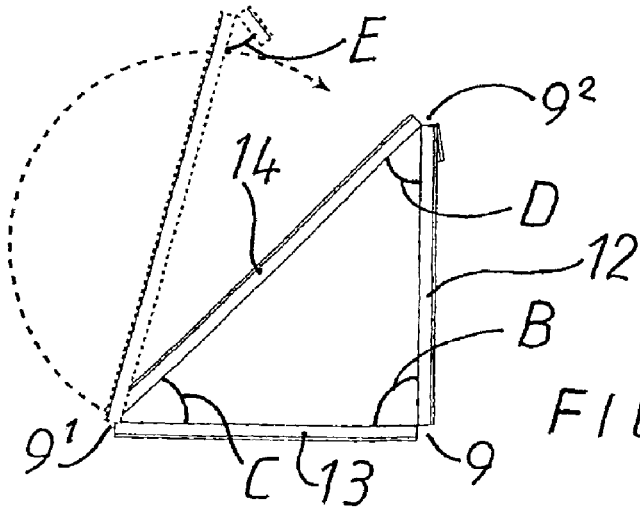
Figure 10:
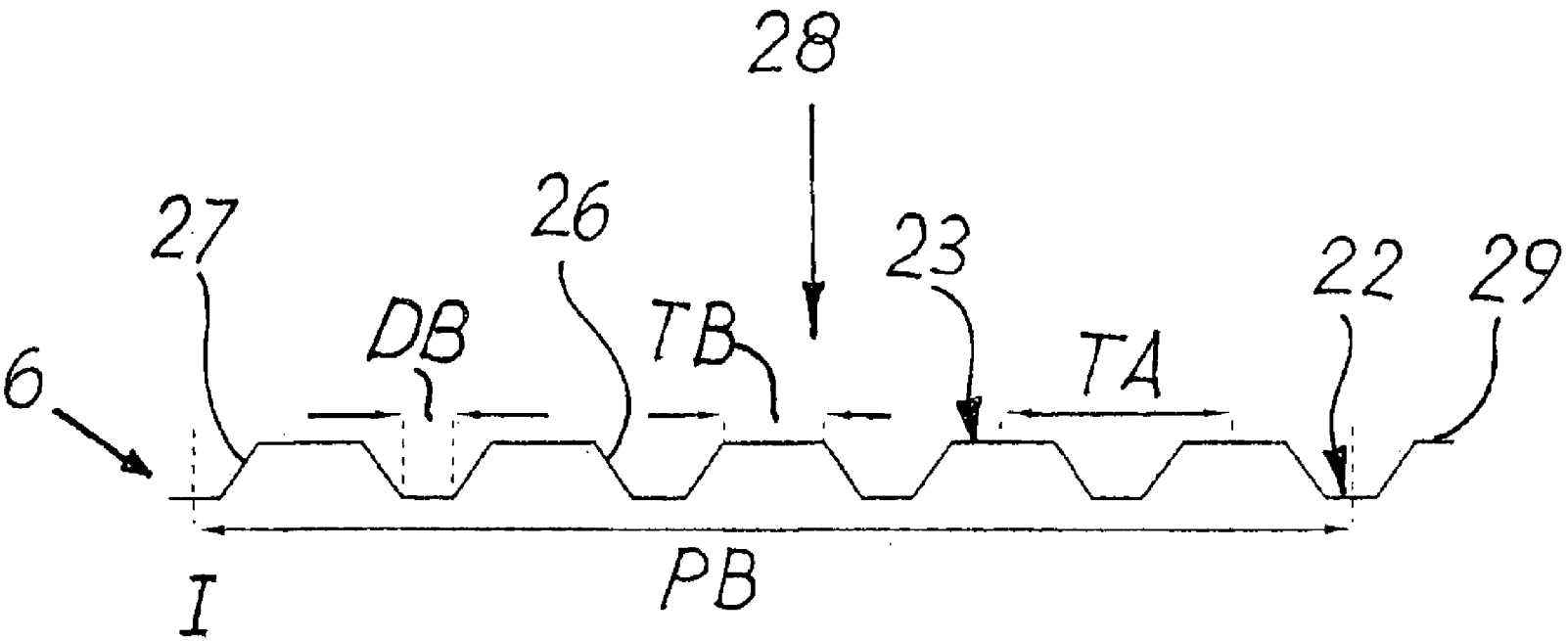
FIGS. 10–11 show a section of a corrugated steel sheet viewed respectively in cross-section and in perspective and with perforations shown.
Figure 11:
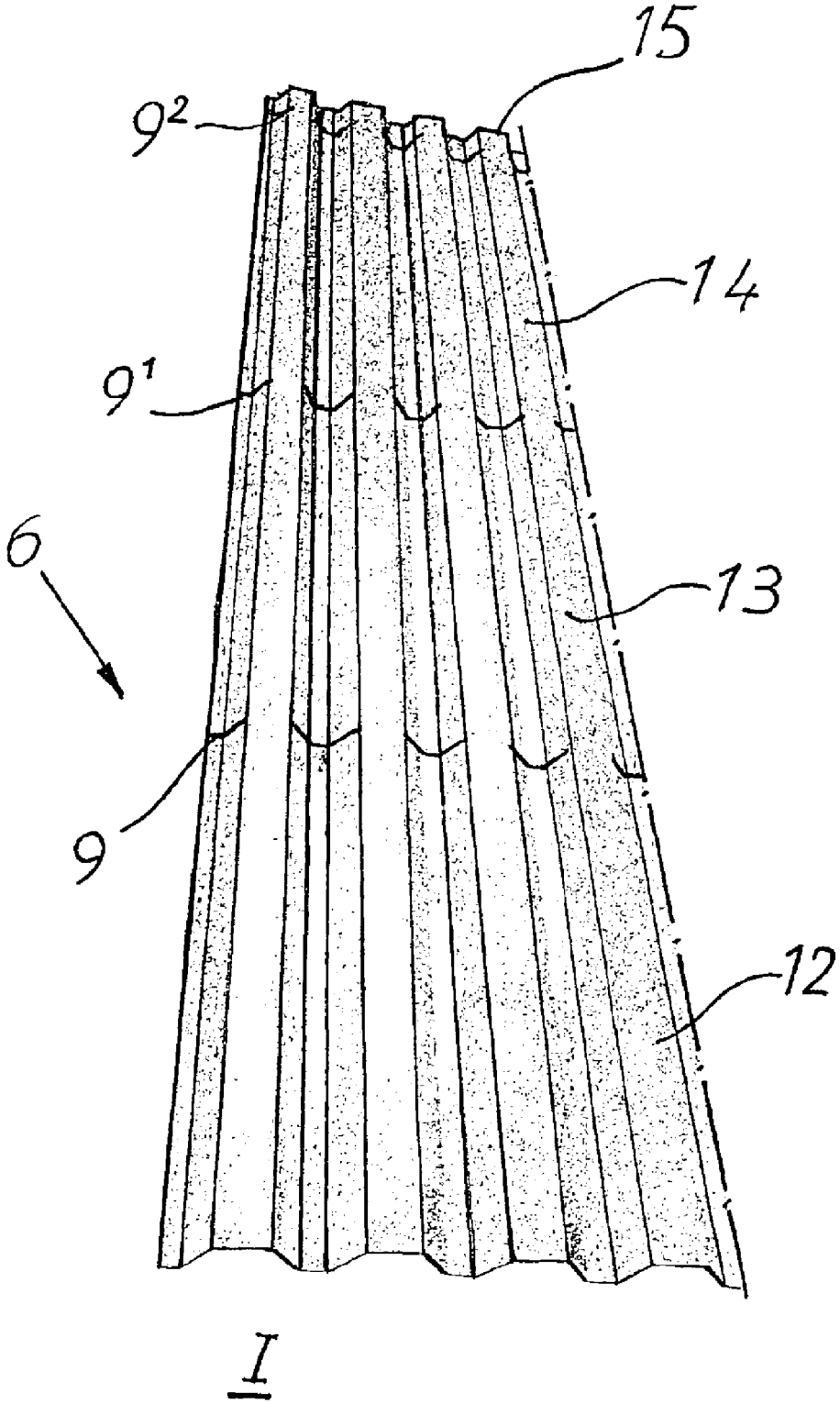

As already mentioned above, the sheets 6, $6^1$, $6^2$, $6^3$ . . . are caused to be folded along previously produced perforations 9, so that a standing support 24 resembling a base is formed in accordance with FIGS. 5 and 9, or the sheets are folded in the middle and the folded sheets are positioned with their respective ends 10A, 11A resting on the ground 17, as shown in FIGS. 1 and 4 in the drawings, for example.

An arrangement 2 that is used to make the aforementioned embankment in areas 25; 125 and to form a barrier 16; 116 and a support to prevent water 4 from entering therein can be appreciated from the above description. The aforementioned barrier support 16; 116 consists of laterally interconnectable and longitudinally corrugated sheets 6, $6^1$, $6^2$, $6^3$ . . . which are perforated across their longitudinal direction in a direction from one side of the sheets and all the way through them as far as the opposing other side of the sheets.

The aforementioned perforations 9, $9^1$, $9^2$, $9^3$ are so arranged as to form folding guides for the sheets 6, $6^1$, $6^2$, $6^3$ . . . in question. In the folded-up angled position, the sheets form a barrier 16; 116 that is capable of being set up on a surface 17 as a support and a means of protection against surrounding water 4.

The aforementioned sheets 6, $6^1$, $6^2$, $6^3$ . . . , which are corrugated in the longitudinal direction of the sheets with downward-pressed troughs 22 and upward-pressed peaks 23, are arranged in such a way as to enable them to be stacked closely against one another and so that they take up little space in the stacked position. This means that the corrugations 22, 23 in all the sheets, etc., are congruent with one another.

The sheets 6, $6^1$, $6^2$, $6^3$ . . . are perforated completely in the bottom valleys 22 and in the sides 26, 27 of the aforementioned corrugations 28, but with the top sections 29 left unperforated. It is the aforementioned remaining unperforated top sections 29 that form folding guides when the sheet is folded.

In the example in accordance with FIGS. 1–4, the sheets 6, $6^1$, $6^2$, $6^3$ . . . are perforated approximately at their centre, whereas the sheets 6, $6^1$, $6^2$, $6^3$ . . . in the illustrative embodiment in FIGS. 5–9 and 11–18 are perforated to form four or five foldable sections 12–15 across the longitudinal direction 8 of the sheets.

The perforation $9^2$ at one end 6A, $6^1$A, $6^2$A, $6^3$A of each of the sheets is so arranged as to form a locking means through an externally situated folding section 15 of the sheets and as to lock the formed upward-folded finished barrier support 116 securely in this way. The locking section 15 is folded down closely against the supporting section 12, and these are locked closely to one another, for example with self-tapping screws.

All of the perforations 9–$9^3$ in the sheets 6, $6^1$, $6^2$, $6^3$ . . . are so arranged as to extend from a common side I of the sheets 6, $6^1$, $6^2$, $6^3$.

Figure 17:
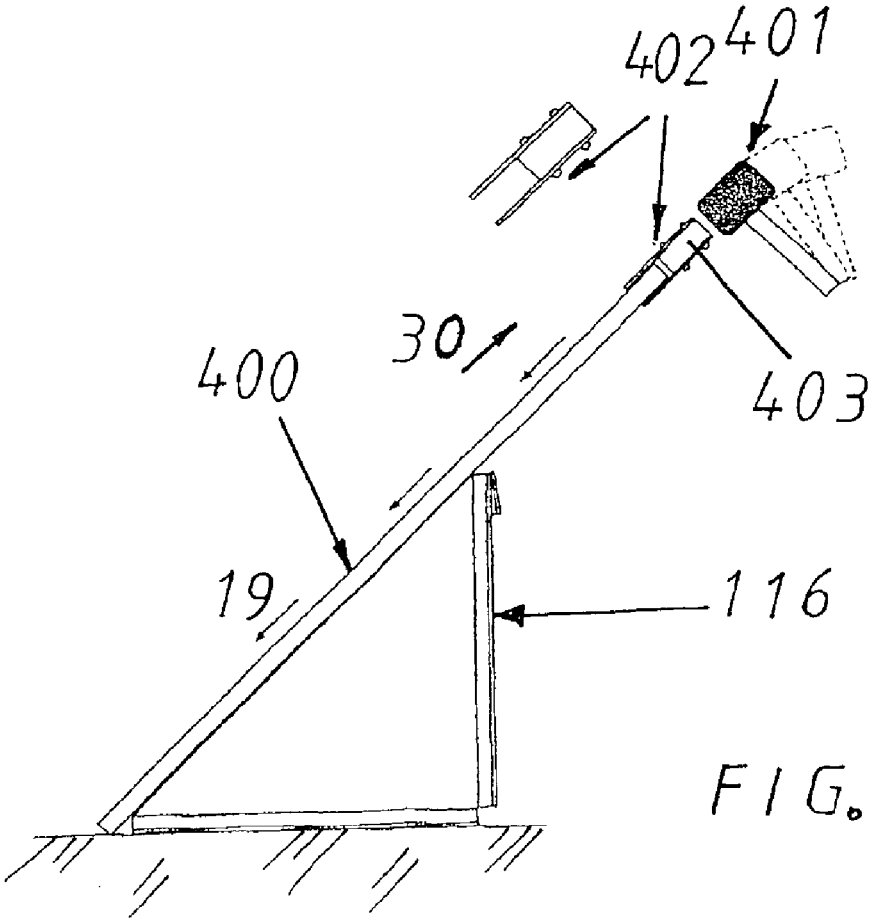
FIG. 17 shows the raising sequence of a barrier of the aforementioned kind.
Figure 18:
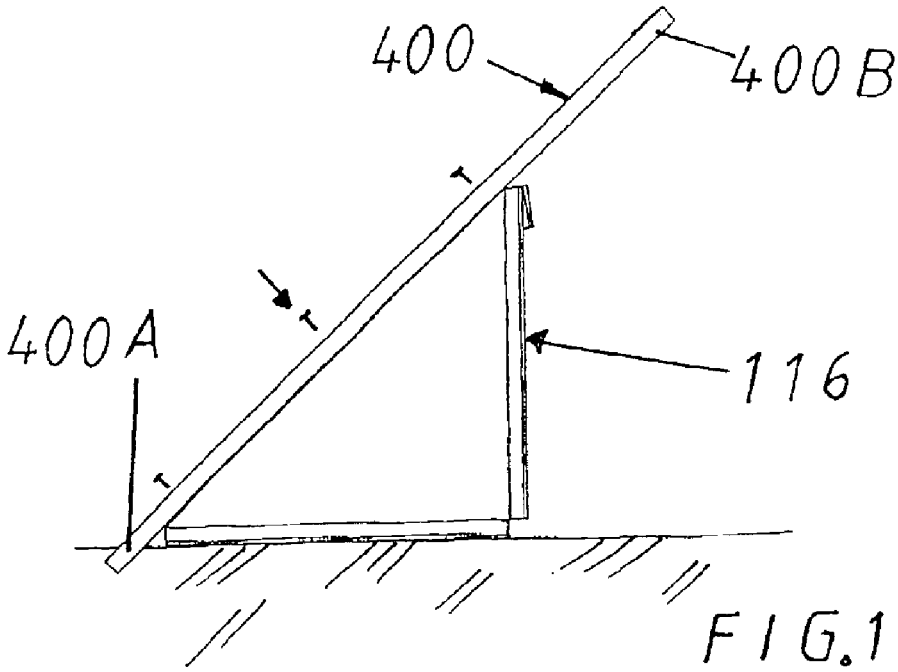
FIG. 18 shows a barrier in the finished, raised position.

The invention thus permits the simple, inexpensive, rapid, secure and hygienic construction of barrier supports against water, for example when spring floods and other watercourses overflow their banks, or on other occasions when the water element threatens to find its way into undesired places. An appropriate dimension for the sheets can be a thickness of between 0.4 and 1.2 millimeters and up to several millimeters, and with a sheet width PB, a trough width DB, a top width TB and a top distance TA of ca 1 meter, 4 cm, 8 cm and 19 cm respectively. The length of the sheets is determined by the height to which it is wished to build the dam and the number of folds. The possibility of increasing the height of the barrier support in accordance with the illustration in FIGS. 17–18 is also available, as explained below.

The sheets are screwed together laterally using a number of self-tapping screws, and a finished barrier support can be formed to take account of natural features with regard both to uneven ground and curves in the lateral sense. The sheets can also be connected together with the help of separate fasteners, the construction and function of which are also explained below.

The barrier support runs like a snake along the desired area that it is wished to dam.

Figure 12:
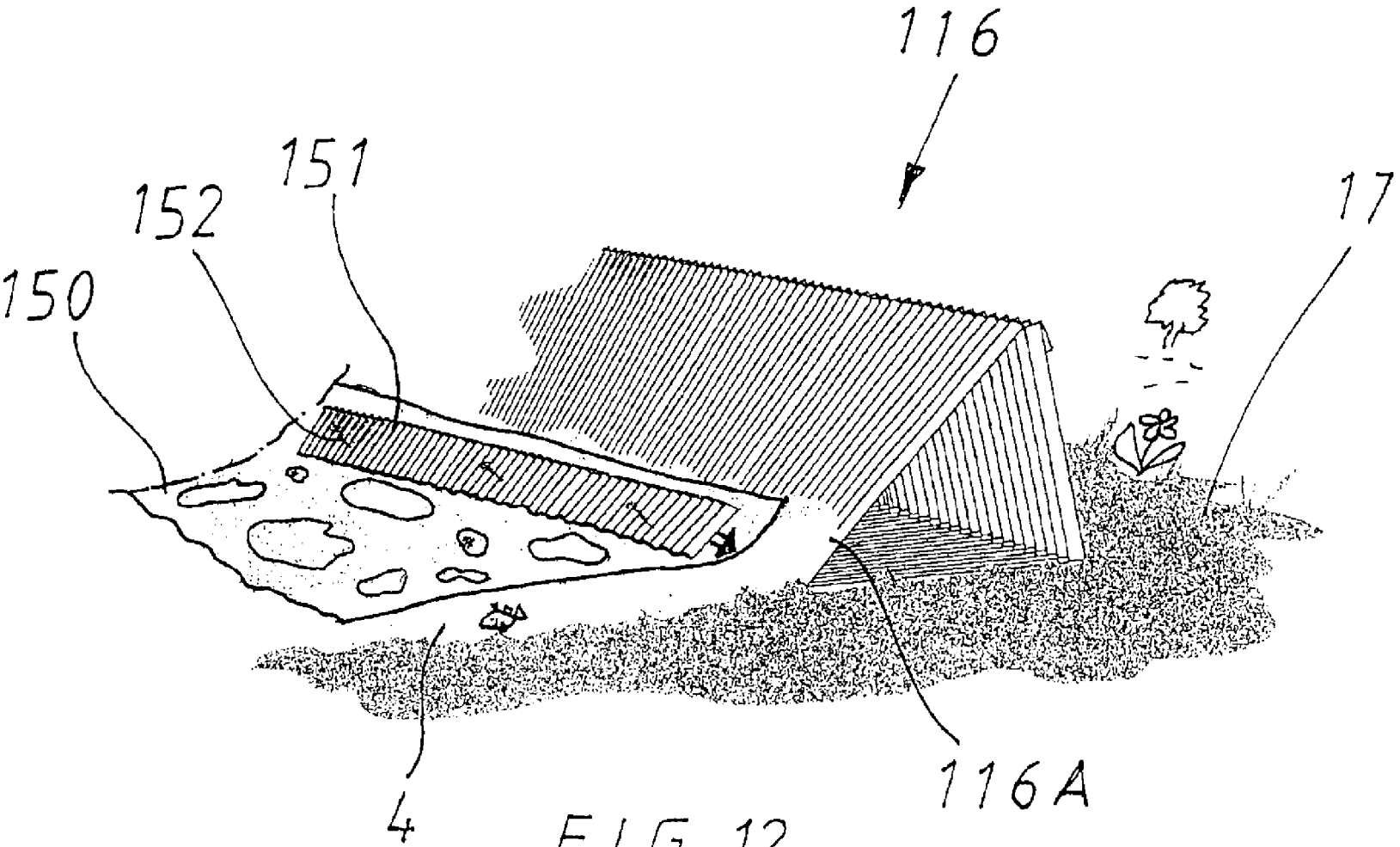
FIG. 12 shows an example of the fixing of a watertight canvas at the foot section of a barrier.

FIG. 12 shows how a liquidtight canvas or some other liquidtight membrane 150 is so arranged as to be attached to the lower section 116A of a barrier support 116 in order to increase the sealing with the ground 17 in the aforementioned erected position. With the help of a securing section 151 in the form of a corrugated fastening strip capable of being placed on top of the barrier support 116 and the membrane 150, the aforementioned sections are secured to the barrier support after fixing with screws 152. Sand or stones or other weights can hold the membrane 150 securely to the ground 17 when the water 4 rises up against the barrier support 116.

Figure 13:
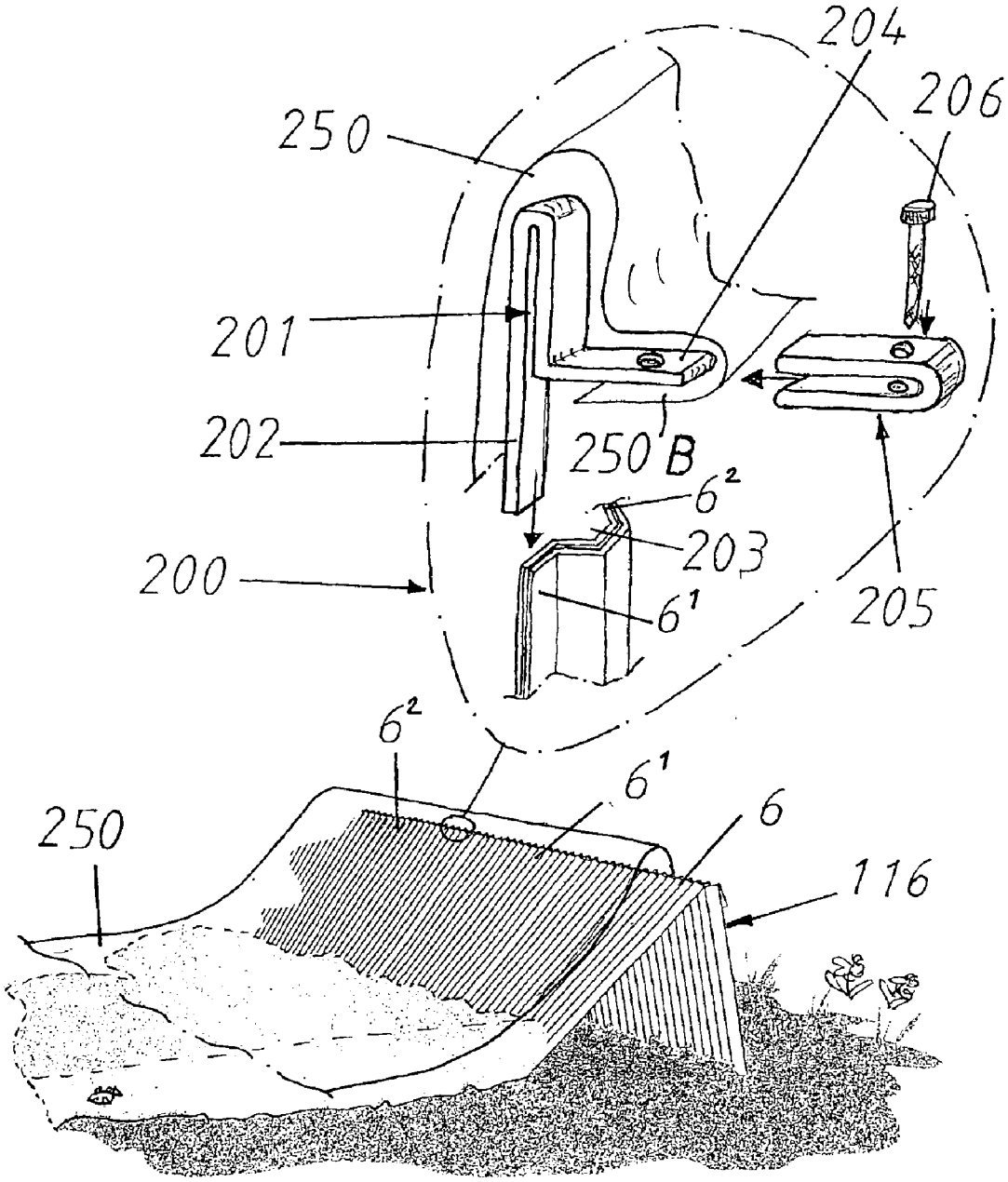
FIG. 13 shows an example of a fixing for holding the sheets together and with securing of the canvas at the top section of the barrier.
Figure 15:
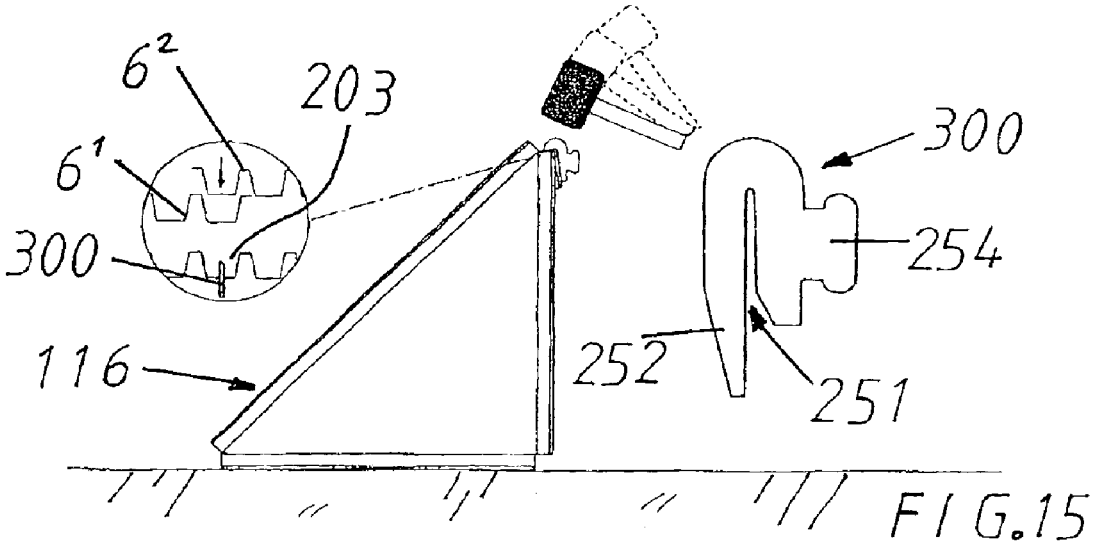
FIG. 15 shows the interconnection of the folded sections of a barrier.
Figure 16:
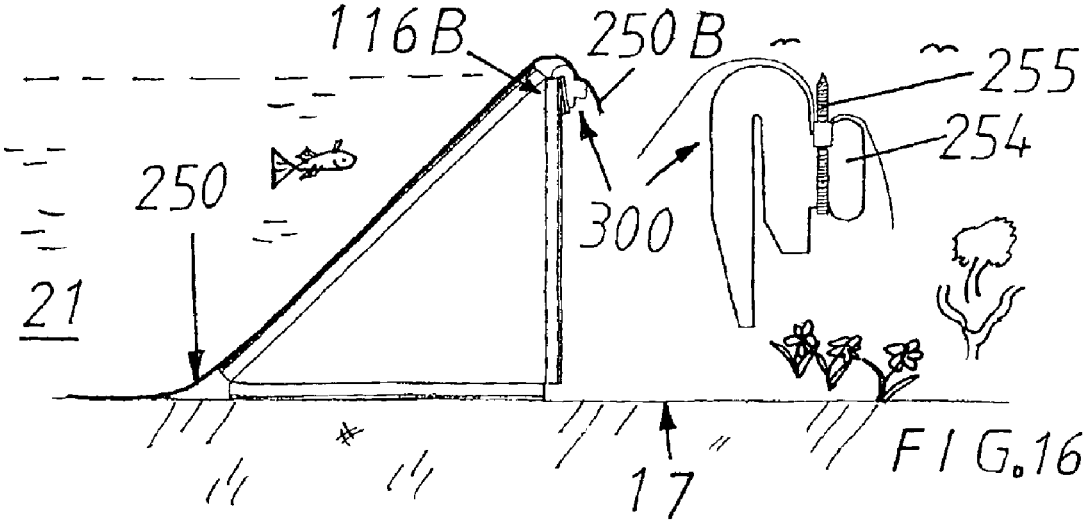
FIG. 16 shows the attachment of a watertight canvas with the help of the aforementioned connection.

FIGS. 13 and 15–16 show examples of other fasteners 200 and 300 to enable the securing of laterally interconnected folded sheets 6, $6^1$, $6^2$, . . . which are so arranged, in the erected position, as to form a barrier support 116 in accordance with the foregoing. Such fasteners 200; 300 are formed by clamps that are so arranged with a clamp section 201 and 251 as to enclose pairs of attached sheet sections $6^1$, $6^2$. The aforementioned fasteners exhibit a pointed front section 202; 252 that can be accommodated in a cavity 203 formed in the aforementioned corrugation.

The aforementioned fasteners 200; 300, which are fitted at uniform intervals along the longitudinal extent of the barrier support 116, also exhibit a securing section 204, 254 to enable an essentially liquidtight membrane 250 in the form of a canvas to be secured all the way up to the top 116B of the barrier support 116 so that the membrane 250 completely covers the barrier support against its intended damming area 21.

The securing section can be in the form of a tongue 204, for example, or some other projection, which a separate U-shaped clamp 205 of loosely matching shape is so arranged as to enclose together with an end section 250B of the membrane 250 wholly or partially folded towards the tongue 205. A nail 206, which is so arranged as to be accommodated in a matching transcurrent hole in the clamp 205 and in the tongue 204 and as to be driven through the membrane 250, holds everything together securely.

FIGS. 15–16 show another embodiment of a fastening 300 in which the securing section for the membrane 250 is formed by a thickened area 254 and in which, for example, a cable tie 255 or some other tensioning device or cord can be so arranged as to enclose and be tightened around the upper section 250B of an aforementioned membrane 250.

An aforementioned barrier support 116 is so arranged as to be capable of being extended essentially in a vertical direction 19 and 30 at the top and/or at the bottom. Use is made in this case of an external panel 400 which exhibits matching corrugations and is capable of attachment closely against the barrier support 116. The aforementioned panel 400 is appropriately driven down into position with the help of a driving tool 401, and to protect the upper end edge of the panel it is possible to use a separate impact end protector 402, which is simply passed over the upper end edge 400B of the panel before striking an impact-resistant section 403 thereon so that the lower edge section 400A of the panel is caused to penetrate into the ground. It is then possible to cause the panel 400 to be screwed securely to the barrier support 116 with screws before finally applying the membrane and securing it with the aforementioned fasteners.

Figure 14:
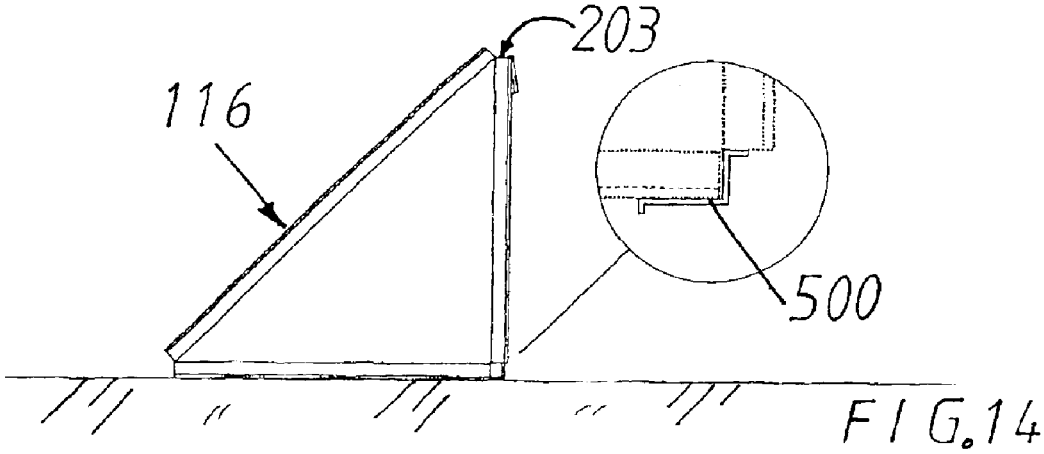
FIG. 14 shows a cross-sectional view of a barrier with a fixing on its perpendicular section.

The reference designation 500 is used in FIG. 14 in respect of an arrester rail that is so arranged as to be capable of being connected to the essentially right-angled corner section of the barrier support. An arrester rail 500 of this kind extends for a number of metres and is preferably attached to the barrier support 116 so that it extends essentially for its entire length. When water presses against the barrier support 116 from the water side, the barrier support is caused to be pressed down at its rear edge, in conjunction with which the arrester rail 500 is forced down into the ground and, in so doing, forms a means of arresting the displacement of the barrier support and prevents its lateral movement. In other words, the barrier support 116 will remain stable at its place of installation. At the same time arrester rails 500 provide a means of protection to stop earth and dirt from finding their way into the inner cavity of the support.

The invention is not restricted to the illustrative embodiments described above and illustrated in the drawings, but may be varied within the scope of the Patent Claims without departing from the idea of invention.

What is claimed is:

1. A method for making an embankment in areas and forming a barrier against water with the help of a support, characterized in that corrugated sheets are folded across their longitudinal direction along perforations in the sheets so that sections of the sheet extend at an angle to one another, in that folded formed barrier supports are positioned on a supporting surface so that a folded section of each sheet forms a barrier support that faces towards the intended damming area and is formed laterally by a number of mutually overlapping folded corrugated sheets.

2. The method in accordance with claim 1, characterized in that the formed barrier support is covered with an essentially liquidtight membrane.

3. The arrangement for making an embankment in areas and forming a barrier against water and which comprises a number of supports in accordance with claim 2, characterized in that the aforementioned supports consist of laterally interconnectable and longitudinally corrugated sheets and in that, in the folded-up angled position, the sheets form a barrier that is capable of being set up on a surface as a support and a means of protection against surrounding water.

4. The arrangement in accordance with claim 3 wherein the sheets are made of a material selected from the group consisting of plastic, steel and aluminum.

5. The arrangement in accordance with claim 4 wherein the material is plastic.

6. The arrangement in accordance with claim 4 wherein the material is steel.

7. The arrangement in accordance with claim 4 wherein the material is aluminum.

8. The method in accordance with claim 1, characterized in that the sheets are folded so that a standing support forming a base is formed, or the sheets are folded in the middle and the folded sheets are positioned with their respective ends resting on the ground.

9. An arrangement for making an embankment in areas and forming a barrier against water and which comprises a number of supports in accordance with claim 1, characterized in that the aforementioned supports consist of laterally interconnectable and longitudinally corrugated sheets and in that, in the folded-up angled position, the sheets form a barrier that is capable of being set up on a surface as a support and a means of protection against surrounding water.

10. The arrangement in accordance with claim 9, characterized in that the sheets are perforated completely in the bottom valleys and in the sides of the aforementioned corrugations, but with the top sections left unperforated.

11. The arrangement in accordance with claim 9, characterized in that the sheets are perforated approximately at their center.

12. The arrangement in accordance with claim 9, characterized in that the sheets are perforated to form four or five foldable sections across the longitudinal direction of the sheets.

13. The arrangement in accordance with claim 12, characterized in that a perforation at one end of the sheets is so arranged as to form a locking means for the formed upward-folded finished barrier support.

14. The arrangement in accordance with claim 12, characterized in that all the perforations are so arranged as to extend from a common side of the sheets.

15. The arrangement in accordance with claim 9, characterized in that the sheets, which are corrugated in the longitudinal direction with downward-pressed troughs and upward-pressed peaks, are arranged to enable them to be stacked closely against one another and so that they take up little space in the stacked position.

16. The arrangement in accordance claim 9, characterized in that separate fasteners to secure laterally interconnected folded sheets are formed by clamps that enclose pairs of attached sheet section.

17. The arrangement in accordance with claim 16, characterized in that the fasteners exhibit a front section that can be accommodated in a cavity in the corrugation.

18. The arrangement in accordance with claim 9, characterized in that the fasteners exhibit a securing section for an essentially liquidtight membrane which covers the barrier support.

19. The arrangement in accordance with claim 18, characterized in that the securing section is in the form of a projection, which a clamp is so arranged as to enclose wholly or partially.

20. The arrangement in accordance with claim 19, characterized in that a nail is so arranged as to be accommodated in a transcurrent hole in the clamp and in the tongue and through the membrane.

21. The arrangement in accordance with claim 9, characterized in that an essentially liquidtight membrane is capable of attachment to the lower section of the barrier support by means of a corrugated securing strip capable of external attachment.

22. The arrangement in accordance with claim 9, characterized in that the barrier support is so arranged at the top and/or at the bottom as to be capable of being extended in a vertical direction with the help of an external panel with corrugations capable of attachment to the barrier support.

23. The arrangement in accordance with claim 9, characterized in that the corrugations in all the sheets are congruent with one another.

24. The arrangement in accordance with claim 9, wherein the sheets are made of a material selected from the group consisting of plastic, steel and aluminum.

25. The arrangement in accordance with claim 24 wherein the material is plastic.

26. The arrangement in accordance with claim 24 wherein the material is steel.

27. The arrangement in accordance with claim 24 wherein the material is aluminum.

* * * * *